US008578836B2

(12) United States Patent
Lorenzut

(10) Patent No.: US 8,578,836 B2
(45) Date of Patent: Nov. 12, 2013

(54) FIREARM WITH ENHANCED HANDLING BY DISSIPATING THE EFFECTS OF RECOIL AND MUZZLE CLIMB

(71) Applicant: Sylvio R. Lorenzut, Lagrangeville, NY (US)

(72) Inventor: Sylvio R. Lorenzut, Lagrangeville, NY (US)

( * ) Notice: Subject to any disclaimer, the term of this patent is extended or adjusted under 35 U.S.C. 154(b) by 0 days.

(21) Appl. No.: 13/651,580

(22) Filed: Oct. 15, 2012

(65) Prior Publication Data

US 2013/0139677 A1 Jun. 6, 2013

Related U.S. Application Data

(63) Continuation of application No. 12/817,824, filed on Jun. 17, 2010, now Pat. No. 8,286,541.

(60) Provisional application No. 61/187,850, filed on Jun. 17, 2009.

(51) Int. Cl.
*F41A 3/12* (2006.01)

(52) U.S. Cl.
USPC ..... 89/195; 42/16

(58) Field of Classification Search
USPC ..... 89/195, 196, 199; 42/16
See application file for complete search history.

(56) References Cited

U.S. PATENT DOCUMENTS

| | | | | | |
|---|---|---|---|---|---|
| 834,753 | A * | 10/1906 | Reifgraber | ..... | 89/144 |
| 2,765,710 | A * | 10/1956 | Bradley | ..... | 89/195 |
| 3,901,125 | A | 8/1975 | Raville | | |
| 4,127,056 | A | 11/1978 | Kart | | |
| 4,594,935 | A | 6/1986 | Smith | | |
| 5,347,912 | A | 9/1994 | Gathoye | | |
| 5,669,169 | A | 9/1997 | Schmitter | | |
| 6,286,241 | B1 | 9/2001 | Constant | | |
| 8,286,541 | B2 | 10/2012 | Lorenzut | | |
| 2004/0025680 | A1 * | 2/2004 | Jebsen et al. | ..... | 89/199 |

* cited by examiner

*Primary Examiner* — Stephen M Johnson
(74) *Attorney, Agent, or Firm* — Peter J. Mikesell; Thomas R. FitzGerald, Esq.; Hiscock & Barclay, LLP

(57) ABSTRACT

A firearm having reduced recoil including a front slide connected to a rear slide by way of a slide link. Firing the firearm causes the rear slide to recoil and transfer energy, by means of the slide link, to the front slide. The front slide moving in the direction opposite the rear slide thereby reducing the recoil of the firearm. After reaching full recoil, the front and rear slides return to their resting positions.

9 Claims, 11 Drawing Sheets

FIREARM WITH ENHANCED HANDLING BY DISSIPATING THE EFFECTS OF RECOIL AND MUZZLE CLIMB

CROSS-REFERENCE TO RELATED APPLICATIONS

This application is a continuation of U.S. patent application Ser. No. 12/817,824, filed Jun. 17, 2010, now U.S. Pat. No. 8,286,541, which claims priority from U.S. Provisional Patent Application Ser. No. 61/187,850, filed Jun. 17, 2009, the contents of which are hereby incorporated in their entirety by reference.

FIELD OF THE INVENTION

This invention relates to a firearm having a reduction in recoil and muzzle climb. In another embodiment the invention relates to a firearm having two slide mechanisms that recoil in substantially opposite directions.

BACKGROUND OF THE INVENTION

Excessive recoil can cause discomfort and flinching upon subsequent shots. Additionally, the recoil can cause muzzle climb resulting in more difficult sight realignment. Conventional handguns utilize a one piece slide which travels rearward, sending the momentum of the recoil force rearward. This momentum is generated after firing of a projectile. The slide is carried rearward the full distance needed to extract and eject spent casings and to chamber a fresh projectile from the magazine. Thus all of the recoil generated by movement of the slide is transferred into the web of the users hand. This movement and weight transfer above and to the rear of the hand, combined with the effect of the projectile exiting the barrel at about the same time, causes the muzzle end of the firearm to rise dramatically. This is known as muzzle climb, and requires the user to readjust the firearm for subsequent shots.

Referring to FIG. 1A, FIG. 1B, and FIG. 1C there is shown a handgun according to the prior art. The handgun 100 has a handle portion 102 a slide 104 and muzzle 106. Upon firing the handgun 100, a projectile 108 leaves the muzzle 106. The recoil results in the slide 104 moving backwards in the direction of arrow 110 away from the direction of the projectile 108. The weight of the slide 104, and the force caused by firing the projectile 108, results in a recoil force. The user of the handgun 100 must absorb this force. The larger caliber projectile that the handgun 100 fires, the larger the recoil force becomes.

In addition to generating recoil the handgun muzzle 106 also tends to climb after the firing of a projectile 108. The recoil generates some rotation around the contact point between the user's hand and the handle portion 102. This action causes the muzzle 106 to climb. As the slide 104 moves backwards, the handgun 100 rotates around the contact point and cause the muzzle 106 to climb. If another projectile is fired without first correcting for this muzzle climb the second projectile would be fired above the first. This is especially problematic in semi-automatic or automatic handguns where accuracy can be greatly reduced in rapid fire situations. Furthermore, the more powerful the projectile the more pronounced the recoil and muzzle climb. Muzzle climb makes reacquiring the sights into the target more difficult.

Existing methods to reduce recoil and muzzle climb include barrel porting, muzzle brakes or compensators. All of which have failed to adequately reduce recoil and muzzle climb to acceptable levels.

Therefore, a handgun having reduced recoil is desired.

Further, a handgun having reduced muzzle climb is desired.

SUMMARY OF THE INVENTION

The invention comprises, in one form thereof, a handgun having two slides. A rear slide that, upon firing of a projectile, moves backwards, and a front slide that, upon firing of the projectile, moves forwards.

More particularly, the invention includes a slide link that connects the front and rear slides. The slide link allows for a portion of the force applied to the rear slide to be transferred to the front slide thereby reducing recoil of the firearm.

The handgun allows for a shorter overall length due to the dual slide mechanism. Furthermore the reduced recoil reduces shooting fatigue during repeated use.

In another form, the invention includes a slot drive to allow portion of the force applied to the rear slide to be transferred to the front slide thereby reducing recoil of the firearm.

An advantage of the present invention is that the oppositely acting slides provide a significant reduction in recoil and muzzle climb.

BRIEF DESCRIPTION OF THE DRAWINGS

The present invention is disclosed with reference to the accompanying drawings, wherein:

FIG. 3B is the top view of the front slide shown in FIG. 3A while

FIG. 6 is a schematic view of a slide arm having a bearing surface according to one embodiment while

FIG. 8 is an isometric view of a slide arm having keyed transfer sections according to one embodiment while

FIG. 11A is a schematic view of a slide arm extension at rest according to one embodiment while

Corresponding reference characters indicate corresponding parts throughout the several views. The examples set out herein illustrate several embodiments of the invention but should not be construed as limiting the scope of the invention in any manner.

DETAILED DESCRIPTION

Figure 1A:
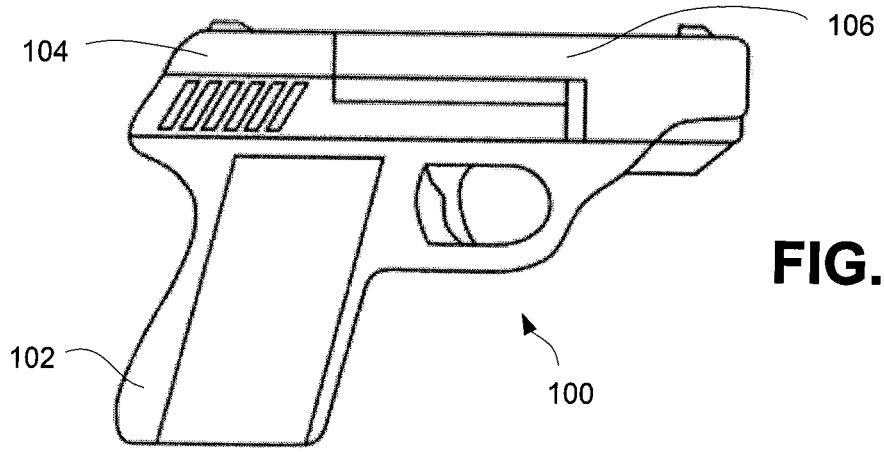
FIG. 1A is a schematic view of a conventional handgun according to the prior art.
Figure 1B:
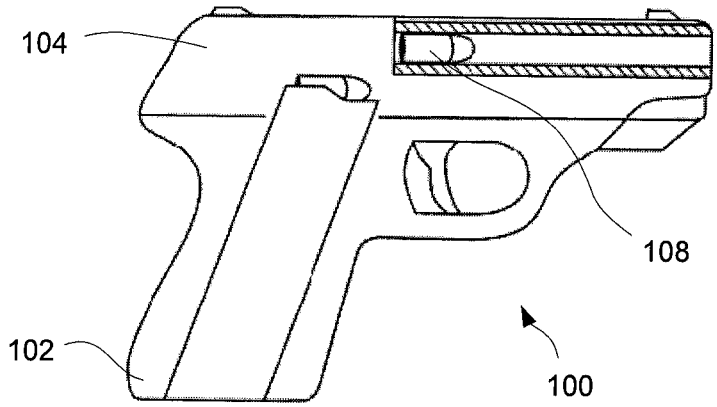
FIG. 1B is a schematic view of a conventional handgun having a projectile in the chamber according to the prior art.
Figure 1C:
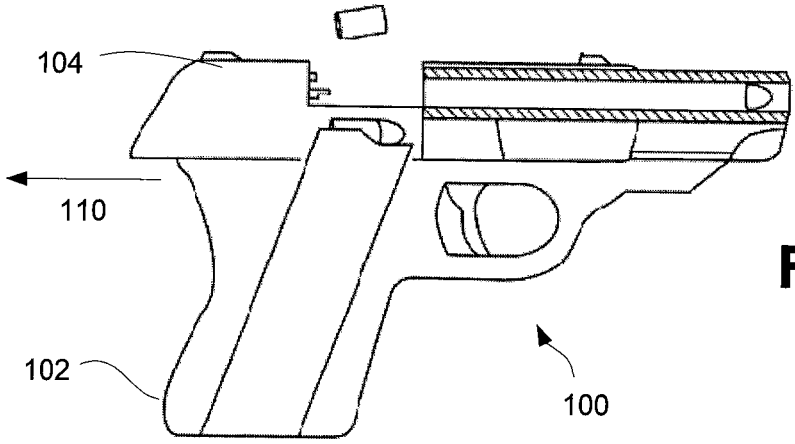
FIG. 1C is a schematic view of a conventional handgun in full recoil according to the prior art.
Figure 2A:
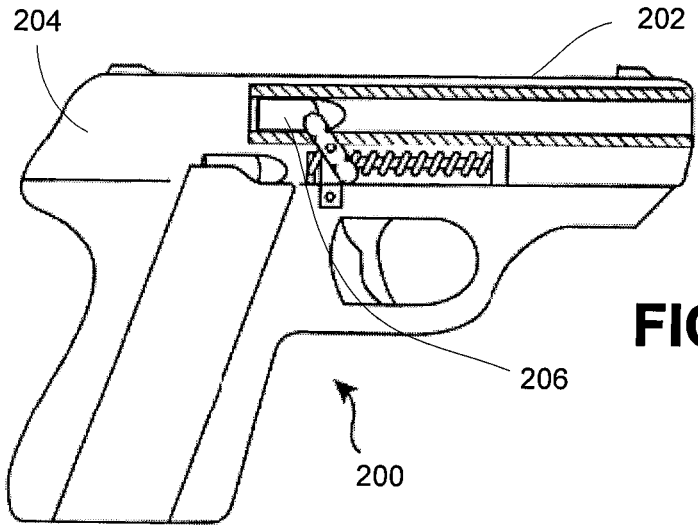
FIG. 2A is a schematic view of a handgun having a projectile in the chamber ready to fire according to one embodiment.

Referring to FIG. 2A there is shown a handgun 200 that includes a front slide 202 and a rear slide 204. As shown in FIG. 2A, the handgun 200 has a projectile 206 in the chamber and is ready to fire. The front slide 202 and rear slide 204 are in communication with each other and the chamber is sealed.

Figure 2B:
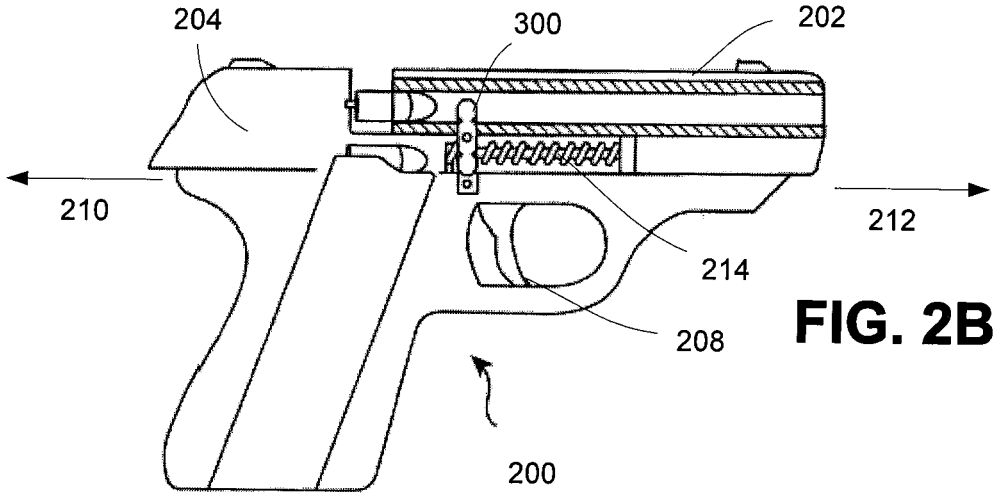
FIG. 2B is a schematic view of the handgun shown in FIG. 2A in full recoil.

Referring now to FIG. 2B, once the trigger 208 has been pulled and the projectile 206 fired, the handgun 200 reaches full recoil. The force generated by discharging the projectile 206 causes the rear slide 204 to move rearward, in the direction of arrow 210, away from the direction the projectile 206 is fired. A slide link 300 connects the rear slide 204 and front slide 202 together. The rear slide 204 pulls back the lower portion of the slide link 300, thereby causing the forward portion to push the front slide 202 forward in the direction of arrow 212. It is understood that the slide link 300 could be modified in any manner so as to cause the front slide 202 and rear slide 204 to recoil in opposing directions.

The recoil force of the rear slide 204 is mitigate by the recoil of the front slide 202. The total recoil felt by the user is thus reduced when compared to a traditional firearm having only a rear slide. Because both the front slide 202 and rear slide 204 move, the recoil distance for each slide is reduced. With a prior art single slide mechanism, that single slide must travel the full distance required for the casing to clear the chamber. With the dual slide system, the travel required for the rear slide 204 is reduced as the front slide 202 moves forward, thereby creating the same opening as a single slide mechanism with a reduced recoil distance. Furthermore, as the front slide 202 travels forward, the added weight over the front end of the barrel reduces the effects of muzzle climb after the projectile is fired.

During recoil the slides 202, 204 compress the recoil spring 214. After reaching full recoil, the recoil spring 214 expands and begins the counter recoil process to return the slides 202, 204 to their original resting position as shown in FIG. 2A.

Figure 2C:
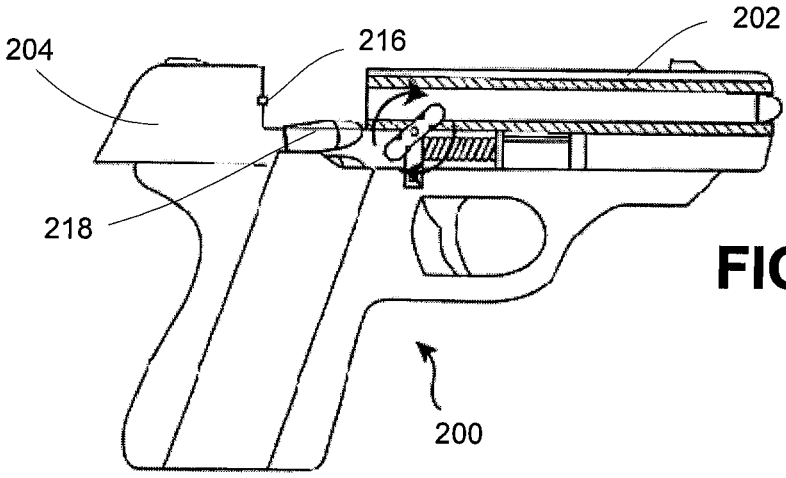
FIG. 2C is a schematic view of the handgun shown in FIG. 2A with a new projectile chambering.

Referring to FIG. 2C, as the slides 202, 204 return to their resting positions, the extractor 216 pulls the empty casing 218 out of the chamber. The empty casing 218 then strikes the ejector 302 (see FIG. 3A) which ejects the empty casing 218. While the extractor 216 and ejector 302 shown in this embodiment demonstrate an effective means for ejecting an empty casing 218, those skilled in the art will understand that any suitable substitute could be made to eject the empty casing 218. In one embodiment the ejector 302 is a fixed ejector. In another embodiment the ejector 302 is a retracting ejector.

Figure 3A:
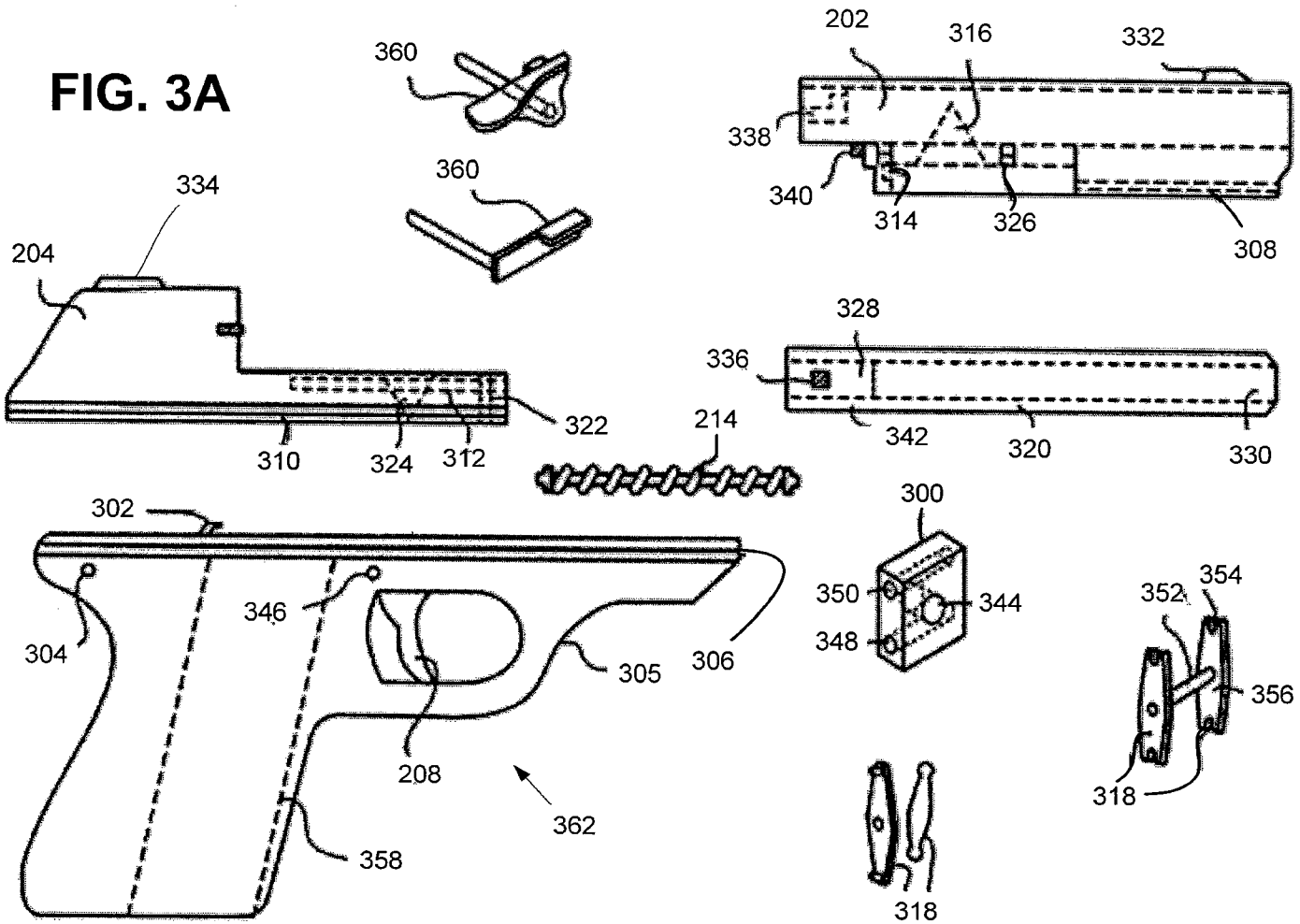
FIG. 3A is a exploded view of the handgun shown in FIGS. 2A-2C.

Referring to FIG. 3A, the handgun 200 is comprised of steel, alloy or composite. In some embodiments, the handgun 200 includes a safety 304 to prevent engagement of the trigger 208. For additional safety precautions the handgun 200 also includes a trigger guard 305 to prevent accidental contact with the trigger 208. It is understood that distinct or additional safety mechanisms may be included without detracting from the invention. In one embodiment the handgun 200 is about 150 mm long, 80 mm high and 30-34 mm wide. It is understood that the dimensions given herein this application are for demonstrative purposes only and should not be construed as limiting. The dimensions set forth relate to a 0.380 ACP, however such dimensions may be modified to optimize characteristics of the firearm or user preferences. The dimensions may be further modified to accommodate use with other caliber firearms.

In one embodiment, the top portion of the handgun 200 includes frame rails 306 for attachment of the front slide 202 and the rear slide 204. The front guide rails 308 and the rear guide rails 310 are designed to mate with the frame rails 306. This allows movement of the front slide 202 and rear slide 204. Optionally, the front guide rails 308 further includes additional guides for attachment to the upper guide rails 312 of the rear slide 204. This additional attachment provides more stable and reliable movement of the slides.

Referring again to FIG. 3A, the slide arms 318 are designed to transfer a portion of the rear slide's 204 rearward motion into the forward motion of the front slide 202. The slide arms 318 rotate around the axis of the slide arm pin 352 which runs through the slide link 300. As the rear slide 204 moves backwards it pulls the lower slide arm portion 356 backwards forcing the slide arms 318 to rotate along the axis of slide arm pin 352. The upper slide arm portion 354 moves forward pushing the front slide 202 forward as well.

The front slide 202 is designed to travel forward along the frame rails 306 in the direction opposite the travel of the rear slide 204. Optionally, the front slide 202 includes a front recoil spring seat 314 and a front slide link insert 316 to attach slide arms 318. The front slide link insert 316 is designed to cradle the slide arms 318. The front slide 202 may be composed of steel, alloy or composite. In one embodiment the front slide 202 includes a barrel 320 that is integrated into the front slide 202. In another embodiment, the barrel 320 is a removable barrel. In one embodiment the front slide 202 is 100 mm long, 30 mm wide and 30 mm high.

The rear slide 204 is designed to travel rearward along the frame rails 306 in the direction opposite the travel of the front slide 202. Optionally, the rear slide includes a rear recoil spring seat 322 and a rear slide link insert 324 to attach slide arms 318. The rear slide link insert 324 is designed to cradle the slide arms 318. The rear slide 130 may be composed of steel, alloy or composite. The bottom edge of the rear slide 204 is machined to form the guide rails 310 which are designed to mate with the frame rails 306. In one embodiment the rear slide 204 is 120 mm long, 30 mm wide and 30 mm high.

In one embodiment, the travel of the slides is limited to a maximum using limit studs 326. In one embodiment, the front slide 202 includes a limit stud 326 in front guide rails 308. As the rear slide 204 moves reward and the front slide 202 moves forward the limit stud 326 limits the maximum travel by contacting the front wall of the rear slide 204. It is understood by those skilled in the art that various mechanisms can be substituted for limit studs. Additionally, the limit stud 326 may be located on the frame, the rear slide 204 and/or the front slide 204 to effectively limit travel of the slides 202, 204.

In another embodiment, the recoil spring 214 limits the maximum travel of the slides 202, 204. Once the recoil spring 214 is fully compressed, the recoil spring 214 prevents further travel of the slides. In yet another embodiment the guide rails 308, 310 contain stops to limit the maximum travel of the slides 202, 204.

The front slide 202 includes a barrel bore to house the barrel 320. The barrel 320 comprises a chamber 328 to house a projectile and a muzzle end 330. The barrel 320 is designed to house a live projectile, contain gas pressure upon ignition and impart a stabilizing spin on the projectile as it exits the muzzle end 330 of the barrel 320. The barrel 320 has a cylindrical bore throughout, sized to the appropriate caliber of the projectile. In one embodiment the barrel 320 is a steel barrel. The size of the barrel 320 will change depending on the caliber of the projectile to be fired. In one embodiment the barrel 320 is between 85 and 100 mm long and about 14 mm in diameter.

Figure 3B:
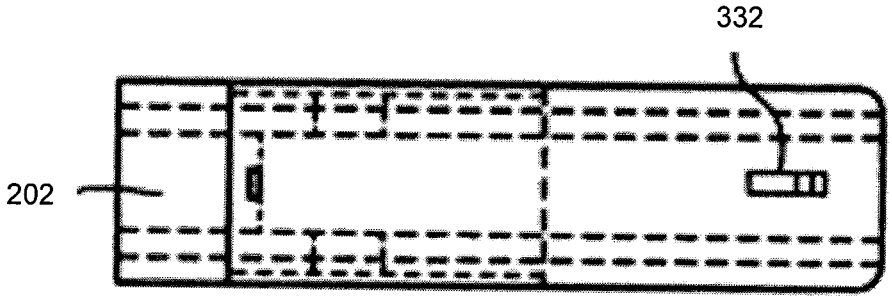
Figure 3C:
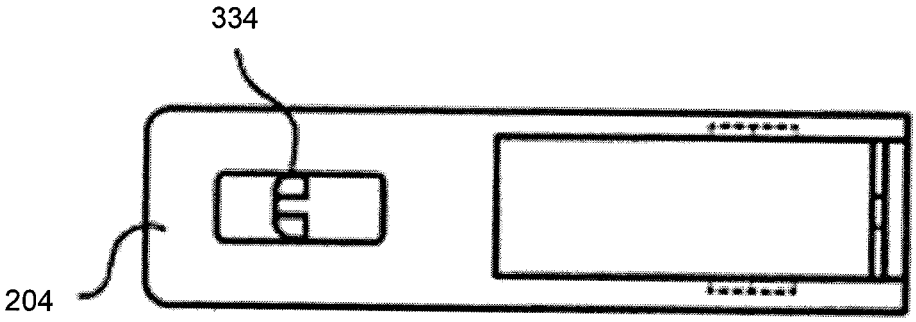
FIG. 3C is the top view of the rear slide shown in FIG. 3A.
Figure 4A:
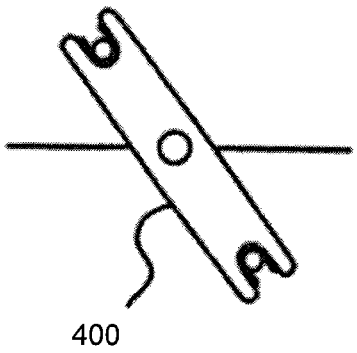
FIG. 4A is schematic view of a slide arm according to one embodiment.
Figure 4C:
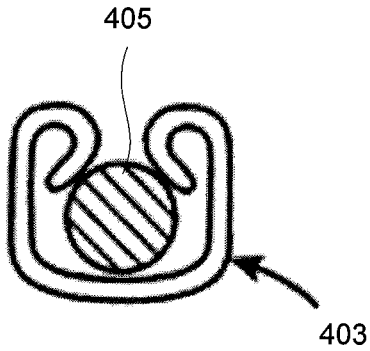
FIG. 4C is a schematic view of a retainer spring according to one embodiment and FIG. 4D is a schematic view of a retainer spring according to one embodiment.
Figure 4B:
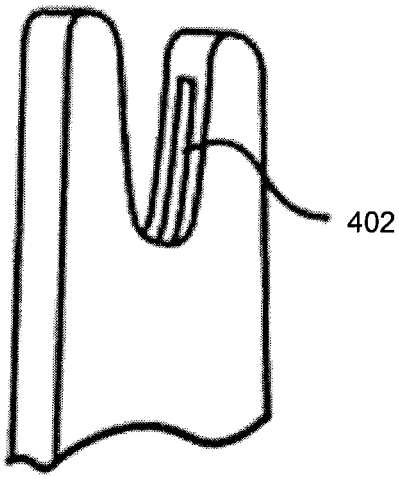
FIG. 4B is an expanded schematic view of the slide arm shown in FIG. 4A.
Figure 4D:
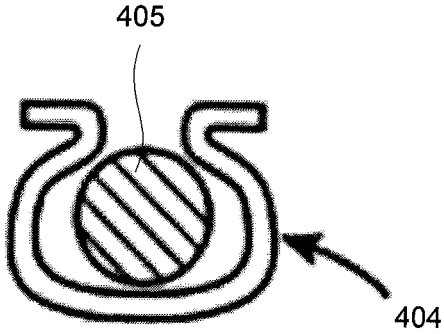
Figure 4E:
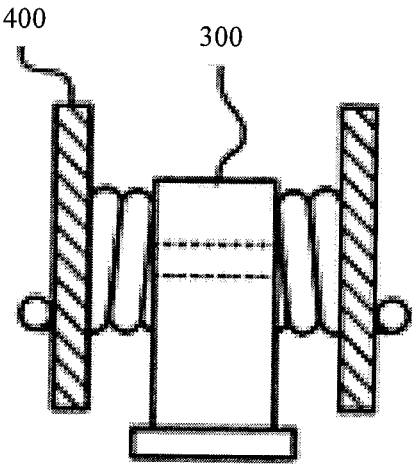
FIGS. 4E, 4F, 4G and 4H are schematic views of a slide arm according to one embodiment.
Figure 4F:
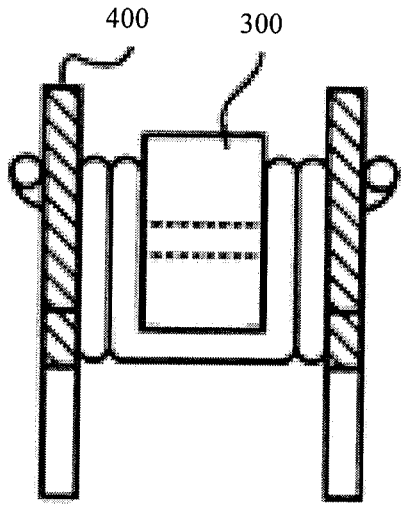
Figure 4G:
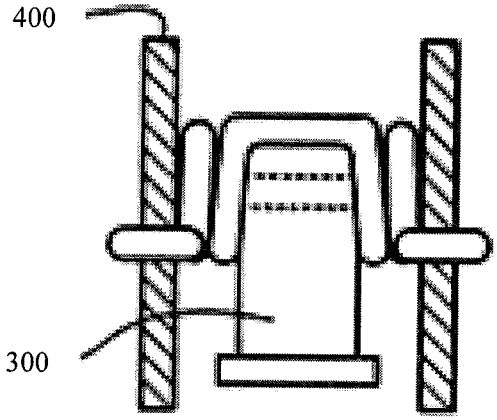
Figure 4H:
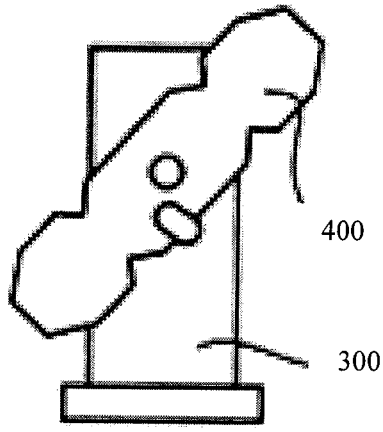

In one embodiment, to improve accuracy, a front sight 332 and a rear sight 334 are attached to the top surfaces of the front slide 202 and rear slide 204, respectively. Also see FIG. 3B and FIG. 3C, which are top views of the front slide 202 and rear slide 204. The sights 332, 334 can be any design known to those skilled in the art. Additionally, the slides 202, 204 may include a mount for a scope or laser sight.

In one embodiment the barrel 320 is connected to the front slide 202 through the barrel bore by inserting the barrel 320 into the front of the barrel bore. The barrel studs 336 on either side of the barrel 320 engage the barrel stud insert 338 of the front slide 202. Upon nearing full insertion, the barrel is rotated to allow the barrel studs 336 to engage the barrel stud insert 338 and lock the barrel 320 in place. As the barrel 320 is rotated a spring loaded detent 340, so positioned in the bottom of the front slide 202, engages a corresponding notch 342 in the barrel 320. The spring loaded detent 340 locks the barrel 320 into the front slide 202 to prevent the barrel 320 from backing out. In one embodiment, the spring loaded detent 340 is a plunger (not shown) that rides on a spring. The spring and plunger are located in a drilled hole in order to limit movement. The spring loaded detente 340 can only be depressed in one direction, allowing a locking projection to pass by the detent. Once passed and the barrel 320 is properly aligned, the spring loaded detent 340 extends, locking the barrel 320 in place. While one embodiment for locking the barrel 320 in place has been described, it is understood that additional methods for locking the barrel 320 in place are known to those skilled in the art.

The front slide 202 may optionally include a recoil chamber. In one embodiment, the recoil chamber includes a front recoil spring seat 314 to hold a recoil spring 214. When assembled, the recoil spring 214 provides resistance between the front slide 202 and the rear slide 204. As the slides 202, 204 travel away from one another, as shown in FIG. 2B, the recoil spring 214 is compressed to store energy. The recoil spring 214 then elongates pushing the front slide 202 and the rear slide 204 back to their resting positions as shown in FIG. 2A. The recoil spring 214 pushes against the front recoil spring seat 314 of the front slide 202 and the rear recoil spring seat 322 of the rear slide 204 to push the slides 202, 204 along the frame rail 306 back to their resting position. In one embodiment, the recoil spring 214 is a helically coiled spring. In one embodiment the recoil spring 214 is about 50 mm long. In another embodiment the recoil spring 214 is an air spring. In yet another embodiment, the recoil spring 214 is a dual stage spring to allow the user to more easily cock the firearm and to provide adequate recoil strength after discharge of the firearm. In a further embodiment, the recoil spring 214 is a hydraulic piston. In yet a further embodiment, the recoil spring 214 is a retainer spring. In one embodiment the recoil spring 214 passes through the spring hole 344 in the slide link 300. While the recoil spring 214 is shown connected above the slide assembly and between the front and rear spring seats 314, 322 it is understood that the recoil chamber is not limited to this position.

Referring again to the exemplary embodiment of FIG. 3A, a slide link 300 is attached to the frame 362. The slide link 300 provides a static surface for which to mount a slide arm 318. In one embodiment, the slide link 300 is a part of the frame 362. In another embodiment, as shown in FIG. 3A, the slide link 300 is removable. By utilizing a removable slide link the firearm becomes field strippable. The slide link 300 is secured to the handgun 200 between the front slide 202 and the rear slide 204 by placing a shaft through the cylindrical pivot bore 346 and the shaft hole 348. The slide link 300 further has a slide arm hole 350 used to secure the slide arms 318. The slide arm pin 352 passes through the slide arm hole 350 to secure the slide arms 318 to the slide link 300 It is understood that the slide arms 318 may be a single slide arm, or as shown in FIG. 3A two slide arms. If two slide arms, they may move independently or be affixed together. In one embodiment the slide link 300 contains two holes bored at the top and bottom, one to secure the mount to the frame and the other to secure the slide arms 318. The slide link 300 should be constructed of a rugged material such as hardened steel to avoid deformation or breakage. In one embodiment, the slide link 300 is about 20 mm wide, 28 mm high and 10 mm thick.

The upper slide arm portion 354 is attached to the front slide link insert 316 on the front slide 202 and the lower slide arm portion 356 is attached to the rear slide link insert 324 on the lower slide 204. The slide arms 318 may be attached to the slides 202, 204 by any suitable means, including but not limited to, pins, shafts and friction mounts.

The upper slide arm portion 354 and lower slide arm portion 356 of the slide arms 318 can be configured with open slots at the ends, studs projecting outward, detents or holes to accept projections from the front or rear slide, or any other means to transfer momentum between the slides during the recoil process. In one embodiment the slide arms 318 are 28 mm high and 5 mm wide. The slide arms 318 should be constructed of a rugged material such as steel.

In one embodiment the handgun 200 further includes a locking system to lock the slides 202, 204 together during cartridge ignition. For most low caliber projectiles the force of the recoil spring 214 is sufficient to seal the chamber 328 during ignition. Furthermore, in some higher caliber projectiles, the initial recoil force is sufficient to seal the chamber 328 during ignition. However, for some projectiles and designs a locking system is utilized to prevent gas leakage during ignition. Locking mechanisms are known to those skilled in the art of handguns having a slide mechanism.

In one embodiment, a magazine is inserted into the magazine well 358 of the frame 362. A projectile from the magazine is pushed into the chamber 328. Upon firing the projectile, the empty casing is ejected and a fresh projectile is fed into the chamber 328 from the magazine. The magazine contains a magazine follower, magazine spring and a magazine release. Upon actuation, the magazine release disengages and the magazine can be removed. The magazine spring is compressed when the magazine 110 is loaded. Upon the ejecting of a spent casing, the spring un-compresses and pushes the magazine follower, and each projectile in the magazine, up towards the chamber 328. Upon the firing of the last projectile, the magazine follower locks the slides in the open position. In one embodiment, the magazine follower pushes up against the slide stop 360 to lock the front slide 202 and the rear slide 204 in the open position, indicating to the user that the last projectile in the magazine has been fired. In one embodiment the slide stop 360 is lever with a shaft, the shaft going through the cylindrical pivot bore 346 in the frame 362 above the trigger 208, and optionally through a hole in the slide link 300. This shaft holds the handgun 200 and the front slide 202 and rear slide 204 together.

Referring to FIG. 4A to FIG. 4H there is shown a slide arm 400 and a spring retention according to one embodiment. The slide arm 400 has a receiving end with a retainer slot 402 to house a retainer spring, such as the retainer spring 403 and/or retainer spring 404. Any suitable retainer spring may be used. The retainer spring holds the stud 405 (attached to the slide) in place thereby affixing the stud 405 to the slide arm 400.

Figure 5:
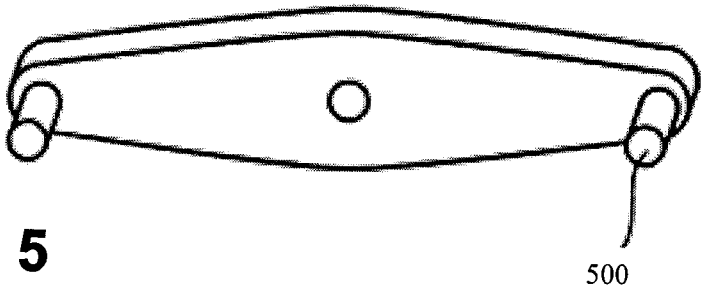
FIG. 5 is a schematic view of a slide arm having studs according to one embodiment.

It is understood that reconfiguration of the slide arms 400 from an open ended slot to a stud 500 projecting out from the slide arms (as shown in FIG. 5) is contemplated.

Figure 6:
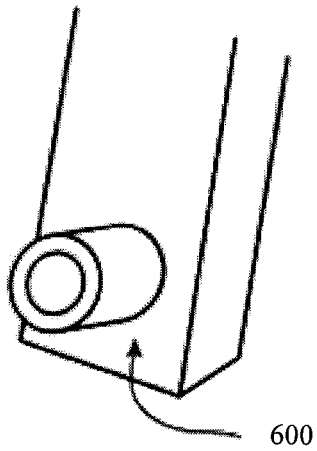

Additionally, the slide arms may be fitted with a bearing surface 600 as shown in FIG. 6 to roll against a surface of the slide.

Figure 7:
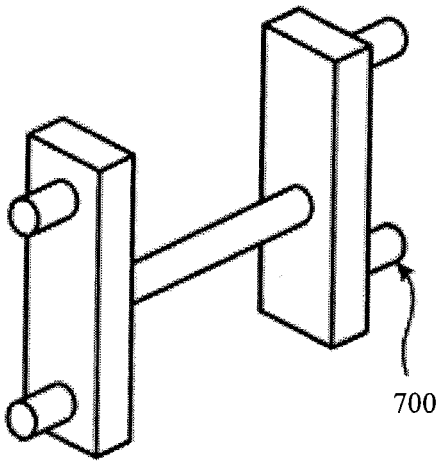
FIG. 7 is a schematic view of a slide arm having posts according to one embodiment.

Further, the slide arms may have posts 700 as shown in FIG. 7 that fit into a detent or opening in the slide arms.

Figure 8:
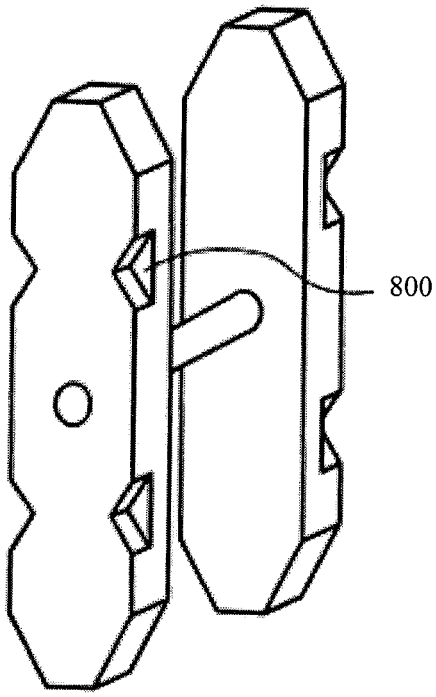

Even further the slide arms may contain keyed transfer sections 800 as shown in FIGS. 8A-8B which correspond to cut sections of the slide arms. It is understood that these examples are demonstrative and are not intended to provide an exhaustive list of slide arm configurations to allow the transfer of recoil energy from the rear slide to the fronts slide.

In one embodiment the slide arms are attached to the slides by insertion into the slide link inserts at a ninety degree angle. Pushing the front slide forward allows interrupted guide rails on the outside of the front slide to drop through slots in the guide rails on the inside of the cradle arms to a lower track allowing the areas of overlap between the front and rear slides to interface smoothly during recoil. In one embodiment slide motion is restricted from overextension by the terminus of the guide rails at the front and rear in the event of slide arm failure.

Figure 9:
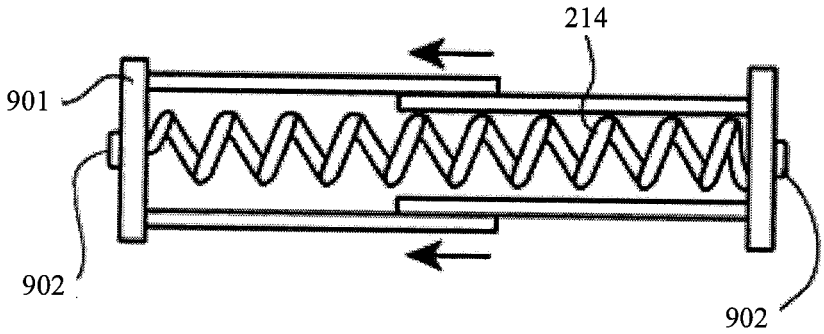
FIG. 9 is a schematic view of a recoil spring and recoil spring housing according to one embodiment.

In one embodiment the recoil spring 214 is housed in a recoil spring housing 901 as shown in FIG. 9. The recoil spring housing 901 having a set of housing studs 902 to properly set the recoil spring 214 housing 901 between the slides (not shown). This embodiment exemplifies the use of a recoil spring 214 to initiate the counter recoil, however it is understood that any suitable device could be used to return the slides 202, 204 to their resting position.

Figure 10A:
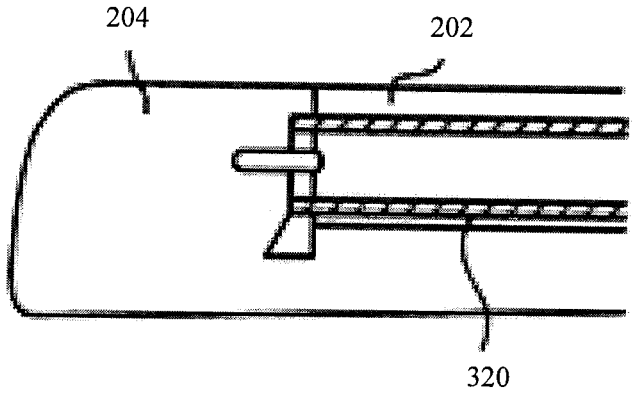
FIG. 10A, FIG. 10B and FIG. 10C are a schematic view showing the fitting of the two slides by use of a barrel recess according to one embodiment.
Figure 10B:
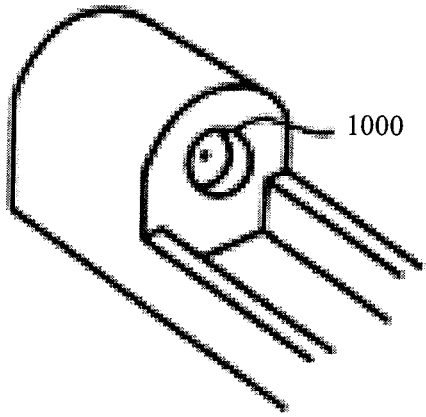
Figure 10C:
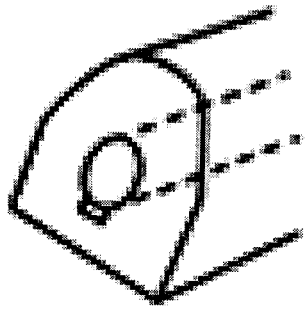

Referring to FIGS. 10A to FIG. 10C there is shown the interface between the front slide 202 and the rear slide 204 according to one embodiment. The rear slide 204 contains a barrel recess 1000 to fit the end of the barrel 320 which is affixed to the front slide 202. The barrel 320 creates a snug fit into the barrel recess 1000 to create a sealed chamber.

Figure 11A:
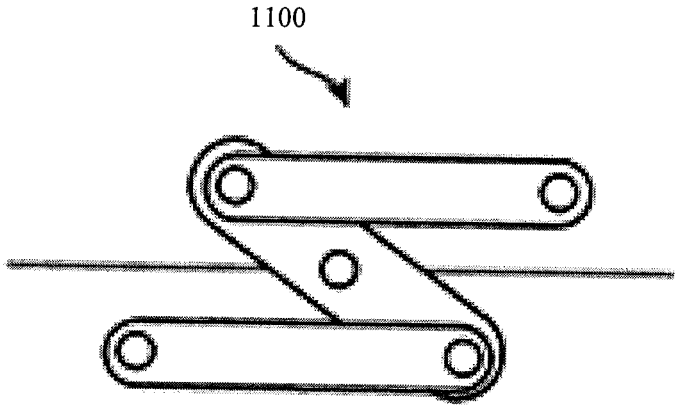
Figure 11B:
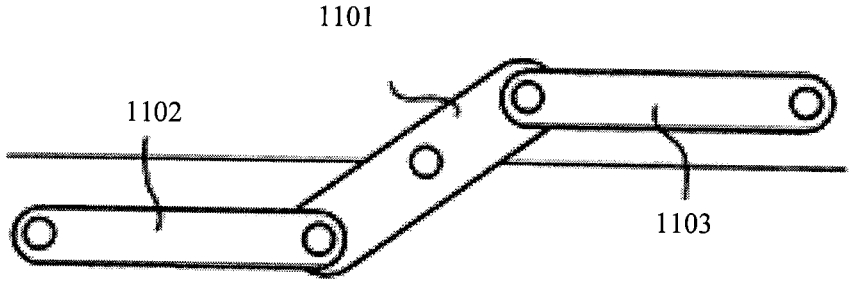
FIG. 11B is a schematic view of a slide arm extension at full recoil according to one embodiment.

While the slide transfer mechanism can be the slide arms as described above, it is understood that any suitable slide transfer mechanism can be used to transfer recoil energy from the rear slide to the front slide, thus allowing the two slides to move in opposing directions. Referring now to FIGS. 11A-11B there is shown an alternative embodiment of a slide transfer mechanism as a slide arm extension 1100. The slide arm extension 1100 has a center arm 1101 affixed to the frame or a pivot mount (not shown), a rear slide arm 1102 and a front slide arm 1103 affixed to each of the slides. As a projectile is fired the rear slide pulls the rear slide arm 1102 backwards (in the same direction as the rear slide) thus causing the center arm 1101 to pivot and push the front slide arm 1103 forward. Being attached to the front slide, the front slide arm 1103 pushes the front slide forward in a direction substantially opposite the direction of the rear slide.

Figure 12:
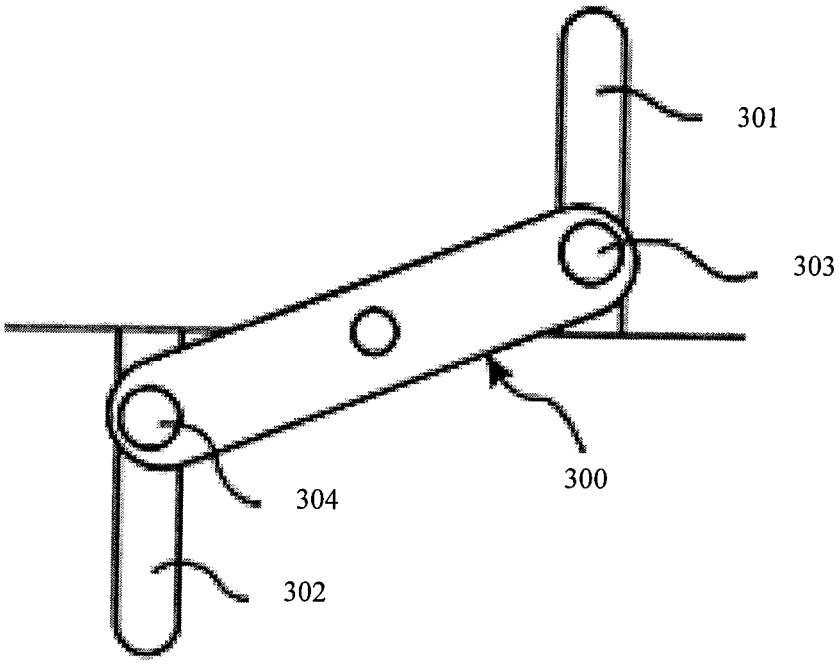
FIG. 12 is a schematic view of a slide arm at rest according to one embodiment.

Referring now to FIG. 12 there is shown yet another slide transfer mechanism according to another embodiment. The slide link 300 is affixed to the frame 362 or a pivot mount (not shown). The slide link 300 having a front projection 303 and a rear projection 304 attached thereto. The front slide has a front slot 301 that forms a track for the front projection 303, and the rear slide has a rear slot 302 forming a track for the rear projection 304. As a projectile is fired and the rear slide moves backwards (relative to the direction of the fired projectile), the rear projection 304 is forced to follow the rear slot 302. This motion causes the slide link 300 to rotate and the front projection 303 to move along the front track 301. This causes the front slide to move forward in a direction opposite that of the rear slide.

In another embodiment the handgun includes a thumbscrew adjustable back strap near the rear portion of the grip to accommodate varying individual grips. The thumbscrew allows adjustment of the size of the handle. Users with smaller or larger hands will appreciate the adjustability and find the grip to be more comfortable in their hand when properly adjusted.

In use, a projectile is loaded into the chamber 142. Pulling the trigger 105 engages the firing pin 136 which fires the projectile. Upon firing, the expanding gases force the rear slide to move reward, in a direction opposite to the fired projectile, and at the same pull the lower slide arm portion 157 to the rear. The slide arms 152 rotate along the slide arm pin 154 causing the upper slide arm portion 156 to move forward and push the front slide 120 forward. The momentum of the front slide 120 counteracts a portion of the momentum of the rear slide 130, thereby reducing the recoil felt by the user and reducing muzzle climb. Additionally, as the recoil spring is compressed between the two slides, each slide receives the same counter recoil force from the spring. As the two slides return to rest, they close above the axis of the hand, not behind, thereby further reducing muzzle climb. Also as the two slides move in opposite directions, each slide must only travel half the distance that that of a traditional slide.

In one embodiment the weight of the front slide is equal to the weight of the rear slide. In another embodiment the weight of the front slide is within 10% of the weight of the rear slide. In yet another embodiment the weight of the front slide is within 2% of the weight of the rear slide.

It is understood that the handgun as described can be converted from a right handed configuration to a left handed configuration by repositioning the extractor, ejector and magazine release accordingly. It is further understood that although a striker-type ignition system is shown. A system utilizing an external hammer is contemplated.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention.

Therefore, it is intended that the invention not be limited to the particular embodiments disclosed as the best mode contemplated for carrying out this invention, but that the invention will include all embodiments falling within the scope and spirit of the appended claims.

What is claimed is:

1. A dual slide firearm comprising:

a rear slide comprising rear guide rails;

a front slide comprising front guide rails;

a slide link comprising an axis and a slide arm, the slide arm having a lower slide arm portion in communication with the rear slide, and an upper slide arm portion in communication with the front slide;

a frame with frame rails configured to mate with the rear guide rails and front guide rails, the frame comprising a magazine well with a magazine follower and a magazine release;

a slide stop configured to lock the rear slide and front slide in an open position when the slide stop contacts the magazine follower;

wherein the firing of a projectile from the dual slide firearm results in the movement of the rear slide in a direction opposite the fired projectile, the rear slide pulling the lower slide arm portion to cause the slide arm to rotate along the axis and the upper slide arm portion to move forward, pushing the front slide in the direction of the fired projectile.

2. The dual slide firearm as recited in claim 1, further comprising a recoil spring coupled to the rear slide and front slide.

3. The dual slide firearm as recited in claim 2, wherein the slide link further comprises a spring hole and the recoil spring passes through the spring hole.

4. The dual slide firearm as recited in claim 1, wherein the slide arm further comprises a slide arm pin disposed in a slide arm hole of the slide link.

5. The dual slide firearm as recited in claim 4, wherein the frame further comprises a cylindrical pivot bore and the slide link further comprises a shaft hole, wherein a shaft passes through the cylindrical pivot bore and the shaft hole to attach the slide link to the frame.

6. The dual slide firearm as recited in claim 1, wherein the front slide has a weight that is within 2% of the weight of the rear slide.

7. A method for operating a dual slide firearm, the method comprising the steps of:

firing a projectile from a dual slide firearm, the duel slide firearm comprising:

a rear slide comprising rear guide rails;

a front slide comprising front guide rails;

a slide link comprising an axis and a slide arm, the slide arm having a lower slide arm portion in communication with the rear slide, and an upper slide arm portion in communication with the front slide;

a frame with frame rails configured to mate with the rear guide rails and front guide rails, the frame comprising a magazine well with a magazine follower and a magazine release; and a slide stop configured to lock the rear slide and front slide in an open position when the slide stop contacts the magazine follower;

wherein the firing of the projectile from the dual slide firearm results in the movement of the rear slide in a direction opposite the fired projectile, the rear slide pulling the lower slide arm portion to cause the slide arm to rotate along the axis and the upper slide arm portion to move forward, pushing the front slide in the direction of the fired projectile;

contacting the magazine follower with the slide stop when the magazine well is empty, the step of contacting causing the slide stop to lock the rear slide and front slide in an open position.

8. The method as recited in claim 7, wherein the duel slide firearm further comprises a recoil spring coupled to the rear slide and front slide, the method comprising the step of pulling rear slide and front slide into a closed position with the recoil spring after the projectile has been filed when the magazine well is not empty.

9. A method for manufacturing a dual slide firearm, the method comprising the steps of:

attaching a slide link to a frame with frame rails and a magazine well with a magazine follower and a magazine release, the slide link comprising an axis and a slide arm comprising a lower slide arm portion and an upper slide arm portion;

attaching a rear slide to the frame rails and the lower slide arm portion, the rear slide comprising rear guide rails;

attaching a front slide to the frame rails and the upper slide arm portion, attaching a slide stop to the frame wherein the slide stop is configured to lock the rear slide and front slide in an open position when the slide stop contacts the magazine follower wherein the firing of a projectile from the firearm results in the movement of the rear slide in a direction opposite the fired projectile, the rear slide pulling the lower slide arm portion causing the slide link to rotate along the axis and said upper slide arm portion to move forward, pushing said front slide in the direction of the fired projectile.

* * * * *